US006173943B1

(12) United States Patent
Welch et al.

(10) Patent No.: US 6,173,943 B1
(45) Date of Patent: Jan. 16, 2001

(54) GUARDRAIL WITH SLIDABLE IMPACT-RECEIVING ELEMENT

(75) Inventors: James B. Welch, Placerville; Owen S. Denman, Granite Bay, both of CA (US)

(73) Assignee: Energy Absorption Systems, Inc., Chicago, IL (US)

( * ) Notice: Under 35 U.S.C. 154(b), the term of this patent shall be extended for 0 days.

(21) Appl. No.: 09/064,443

(22) Filed: Apr. 22, 1998

(51) Int. Cl.[7] ..... E01F 15/00
(52) U.S. Cl. ..... 256/13.1; 404/6
(58) Field of Search ..... 256/13.1, 1; 404/6, 404/9, 10

(56) References Cited

U.S. PATENT DOCUMENTS

| | | | | |
|---|---|---|---|---|
| 4,678,166 | * | 7/1987 | Bronstad et al. | 256/13.1 |
| 4,928,928 | * | 5/1990 | Buth et al. | 256/13.1 |
| 5,022,782 | * | 6/1991 | Gertz et al. | 404/6 |
| 5,078,366 | * | 1/1992 | Sicking et al. | 256/13.1 |
| 5,391,016 | * | 2/1995 | Ivey et al. | 404/6 |
| 5,407,298 | | 4/1995 | Sicking . | |
| 5,503,495 | | 4/1996 | Mak . | |
| 5,547,309 | | 8/1996 | Sicking . | |
| 5,775,675 | * | 7/1998 | Sicking et al. | 256/13.1 |
| 5,791,812 | * | 8/1998 | Ivey | 404/6 |
| 5,797,591 | * | 8/1998 | Krage | 256/13.1 |
| 5,957,435 | * | 9/1999 | Bronstad | 256/13.1 |
| 5,967,497 | * | 10/1999 | Denman et al. | 256/13.1 |
| 6,022,003 | * | 2/2000 | Sicking et al. | 256/13.1 |

* cited by examiner

*Primary Examiner*—Harry C. Kim
(74) *Attorney, Agent, or Firm*—Brinks Hofer Gilson & Lione

(57) ABSTRACT

A guardrail includes an array of vehicle-deflecting rails secured to an array of posts extending along a roadway. An impact-receiving element is slidably mounted to the forward end of the array of rails, and this impact-receiving element includes a vehicle-engaging portion having a first frontal area that is substantially greater than a second frontal area characteristic of the first end of the array of rails. A column is interposed between a forward portion of the impact-receiving element and the first post to apply initial compressive forces in a collision directly to the first post.

25 Claims, 7 Drawing Sheets

GUARDRAIL WITH SLIDABLE IMPACT-RECEIVING ELEMENT

BACKGROUND

The present invention relates to guardrails of the type that are placed alongside a roadway to redirect a moving vehicle that has left the roadway.

Modern guardrails are relied on for two separate functions that are to some extent in tension with one another. First, the guardrail preferably has adequate tensional strength in the longitudinal direction that a vehicle striking an intermediate portion of the guardrail at an oblique angle will be prevented from passing through the guardrail and redirected along the length of the guardrail. This function requires considerable tensional strength.

Second, the guardrail preferably slows a vehicle that strikes the end of the guardrail at a suitable rate such that excessive decelerations are not applied to the vehicle and the guardrail does not impale the vehicle.

Various prior-art approaches have been suggested for accommodating these two separate functions of guardrail design. See for example, Sicking U.S. Pat. Nos. 5,547,309 and 5,407,298, Mak U.S. Pat. 5,503,495, and U.S. patent application Ser. No. 08/990,468 (U.S. Pat. No. 5,967,497), filed Dec. 15, 1997, assigned to the assignee of the present invention.

The present invention is directed to improvements in guardrails that further reduce any tendency of the guardrail to impale an impacting vehicle while maintaining a desired level of longitudinal tensional strength.

SUMMARY

The present invention is defined by the following claims, and nothing in this section should be taken as a limitation on those claims.

By way of introduction, the preferred embodiment described below includes a guardrail having an array of vehicle-deflecting rails secured to an array of posts. This embodiment further includes an impact-receiving element that is slidably mounted to the forward end of the first rail. This impact-receiving element includes a vehicle-engaging portion having a frontal area substantially greater than the frontal area of the end of the first rail. Because the impact-receiving element is slidably mounted to the first rail, an impacting vehicle initially accelerates the impact-receiving element, without substantially accelerating or deforming the remaining rails. Since the frontal area of the impact-receiving element is substantially greater than that of the first rail, impact forces on the vehicle are spread. These two features cooperate to reduce any tendency of the guardrail to impale the vehicle.

DETAILED DESCRIPTION OF THE PRESENTLY PREFERRED EMBODIMENTS

Figure 1:
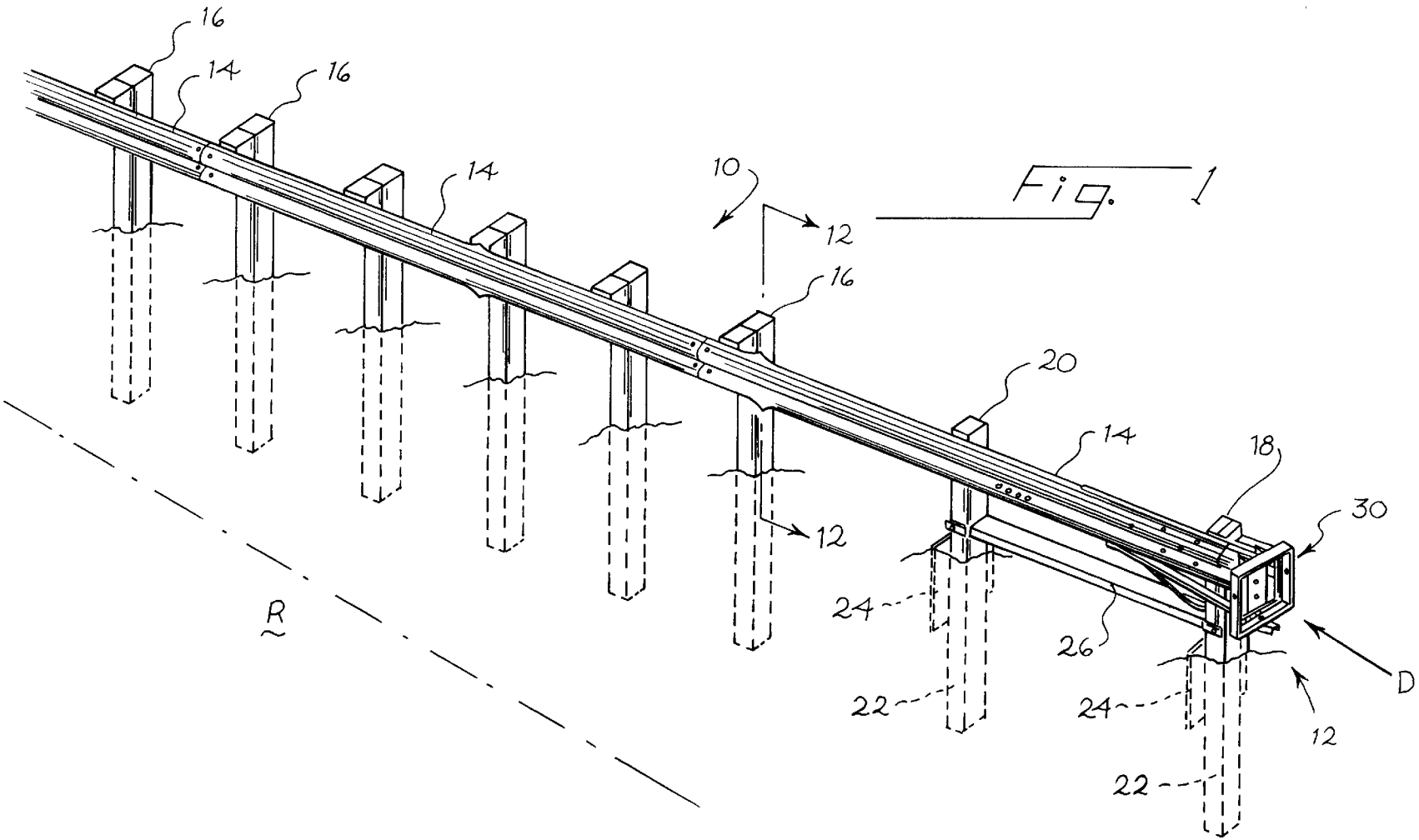
FIG. 1 is a perspective view of a guardrail that incorporates a presently preferred embodiment of this invention.

Turning now to the drawings, FIG. 1 shows a perspective view of a guardrail 10 that incorporates a presently preferred embodiment of this invention. The guardrail 10 is mounted alongside a roadway R, and the forward end 12 of the guardrail 10 faces an anticipated impact direction D.

As shown in FIG. 1, the guardrail 10 includes an array of rails 14 secured to an array of posts 16. The posts 16 are partially buried in the ground, and they are numbered consecutively, starting with a first post 18 at the front end of the guardrail 10, followed by a second post 20, and so forth. In this embodiment, the first and second posts, 18, 20 are received in foundation tubes 22 provided with soil plates 24. Additionally, the first and second posts 18, 20 are interconnected by a strut 26. These features cooperate to immobilize the first and second posts 18, 20 at ground level, thereby enhancing the tendency of the first and second posts 18, 20 to break off cleanly at ground level in an axial impact.

Figure 2:
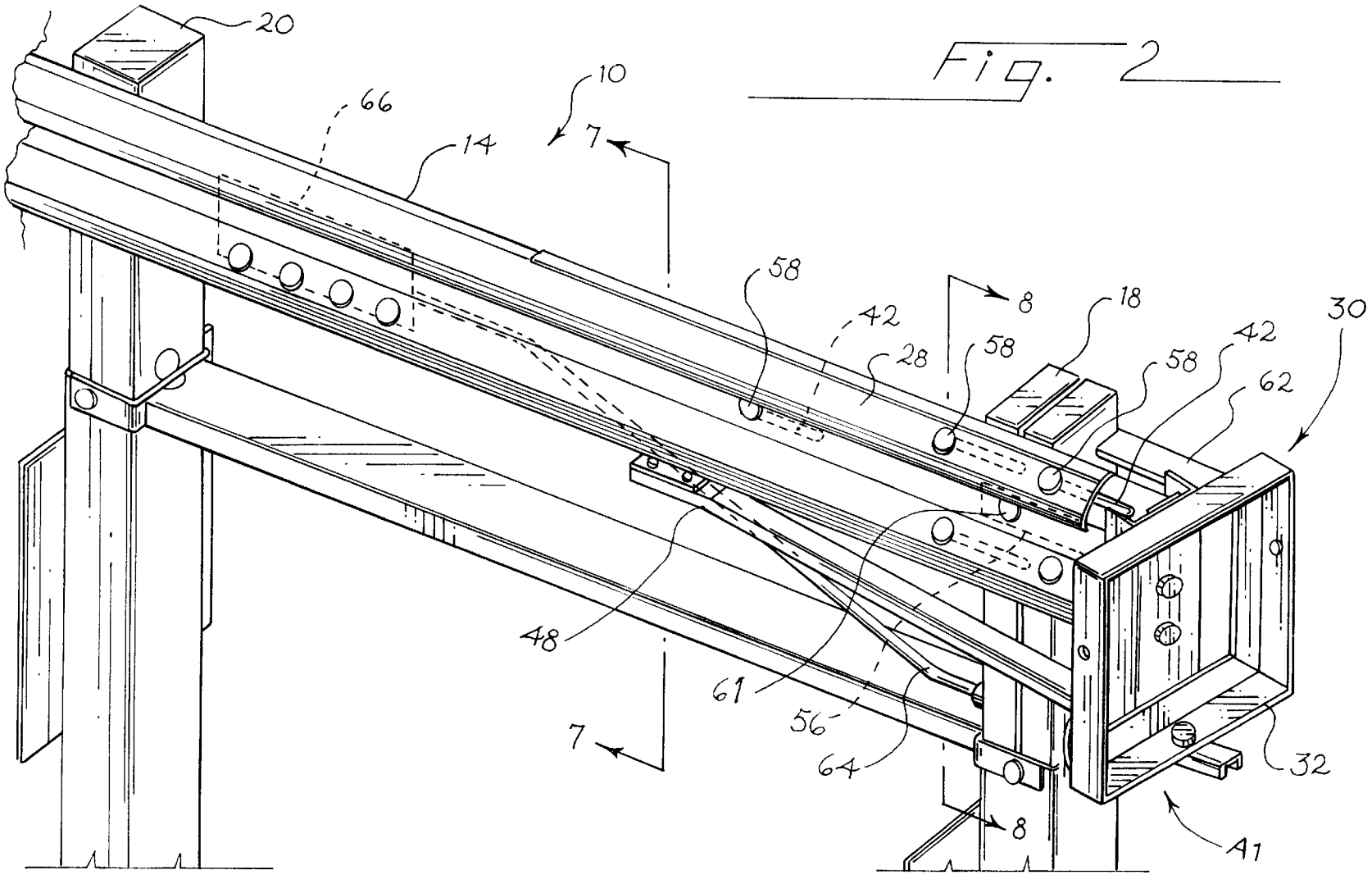
FIG. 2 is an enlarged perspective view of the front portion of the guardrail of FIG. 1.

As best shown in FIG. 2, the forward-most rail 14 supports at its forward end 28 an impact-receiving element 30. This impact-receiving element 30 is shown in perspective view in FIG. 3. The forward end of the impact-receiving element 30 takes the form of a vehicle-engaging portion 32 that is bolted in place to the forward end of a guide rail 34.

Figures 4, 5, 6:
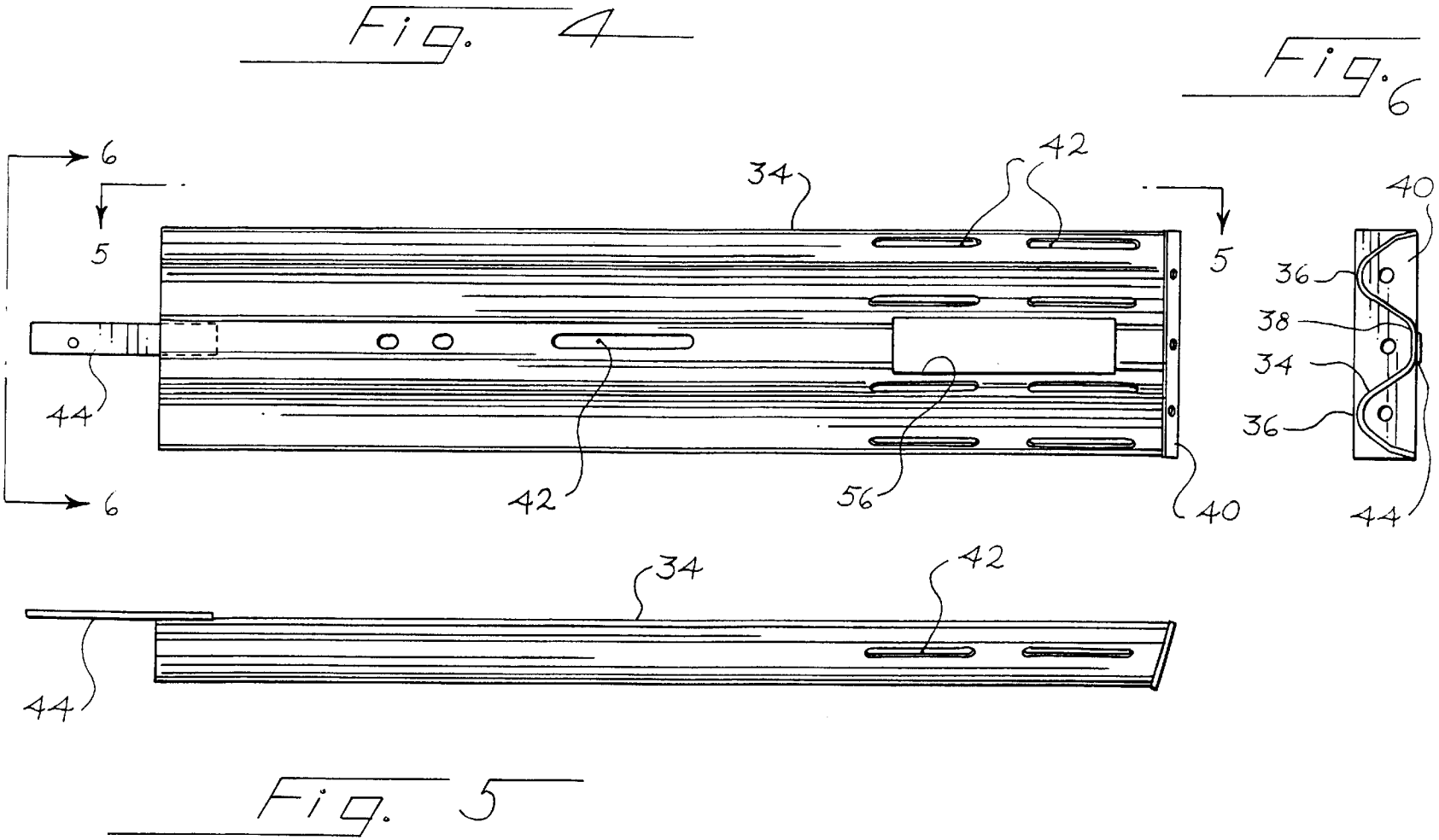
FIG. 4 is a side view of a guide rail included in the impact-receiving element of FIG. 3.
FIG. 5 is a top view taken along line 5—5 of FIG. 4.
FIG. 6 is a rear view taken along line 6—6 of FIG. 4.

The guide rail 34 is shown in FIGS. 4, 5 and 6. As best shown in FIG. 6, the guide rail 34 defines two axially extending ridges 36, separated by an axially extending valley 38. Such rails are conventionally known in the art as W-beams, and the guide rail 34 has generally the same cross-sectional shape as the rails 14 of the guardrail 10 (FIG. 1).

A mounting plate 40 is secured to the forward end of the guide rail 34, as for example by welding. In this embodiment, the mounting plate 40 is oriented at a skew angle with respect to the longitudinal axis of the guide rail 34. This is not required in all embodiments, but it provides the advantage that the vehicle-engaging portion 32 may be mounted perpendicular to the anticipated impact direction D (FIG. 1) even though the forward end of the guardrail 10 is flared outwardly from the roadway R and is therefore itself not aligned with the anticipated impact direction D.

As best shown in FIG. 4, the guide rail 34 also defines an array of nine slots 42, each extending axially along the guide rail 34. A tongue 44 is mounted centrally to the guide rail 34 to extend rearwardly of the guide rail 34. Additionally, a window 56 is formed in the forward portion of the guide rail 34.

Returning to FIG. 3, the vehicle-engaging portion 32 is secured, as for example with threaded fasteners, to the mounting plate 40 via a C-channel 46. In this embodiment the vehicle-engaging portion 32 itself is welded from angle-iron segments.

Figure 3:
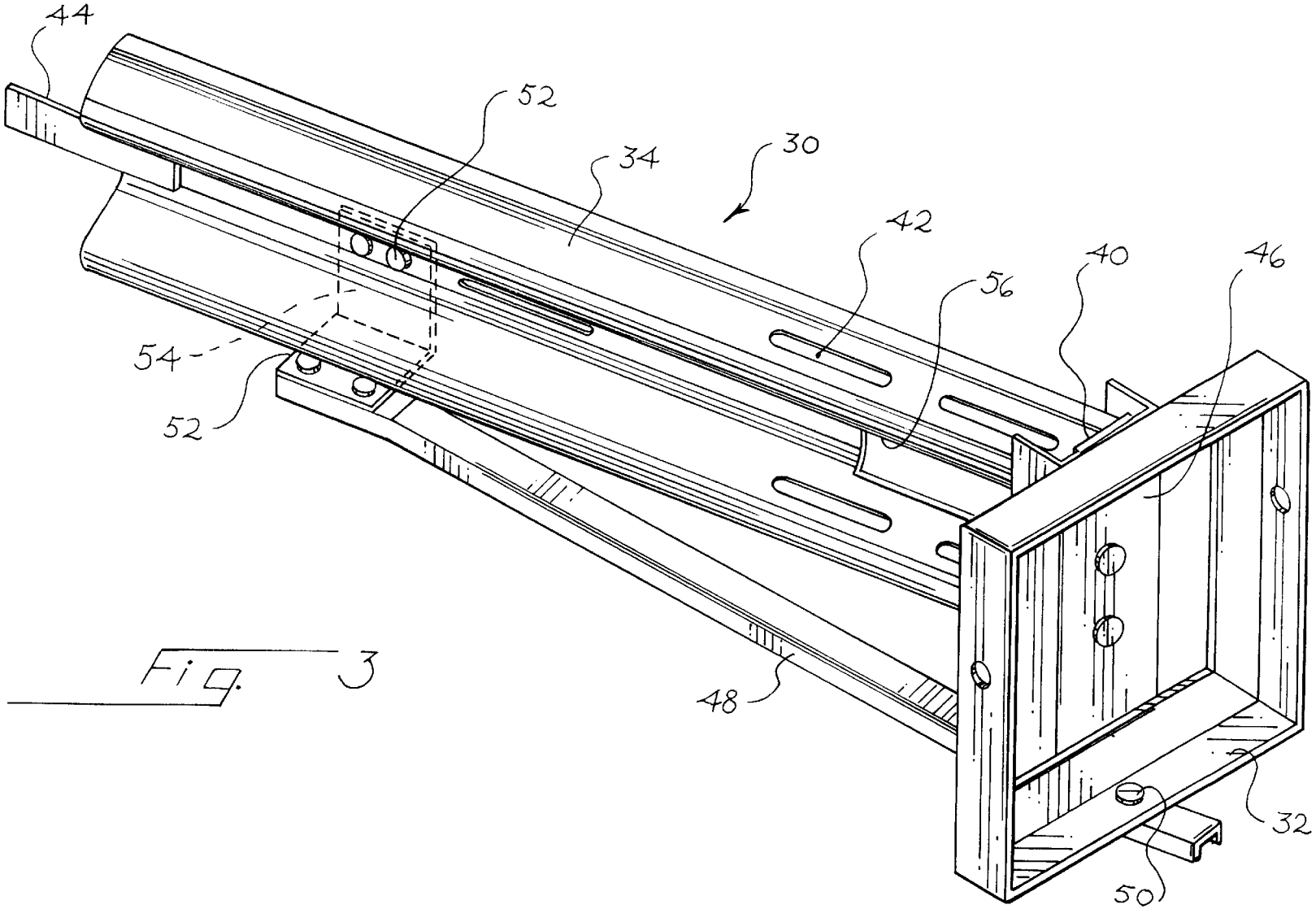
FIG. 3 is a perspective view of an impact-receiving element included in the embodiments of FIGS. 1 and 2.

As shown in FIG. 3, a brace 48 extends between the lower portion of the vehicle-engaging portion 32 and a rearward portion of the guide rail 34. The front of the brace 48 is bolted with a fastener 50 to the bottom of the vehicle-engaging portion 32. The rear of the brace 48 is bolted via fasteners 52 and an angle bracket 54 to the valley 38 of the guide rail 34.

Figure 8:
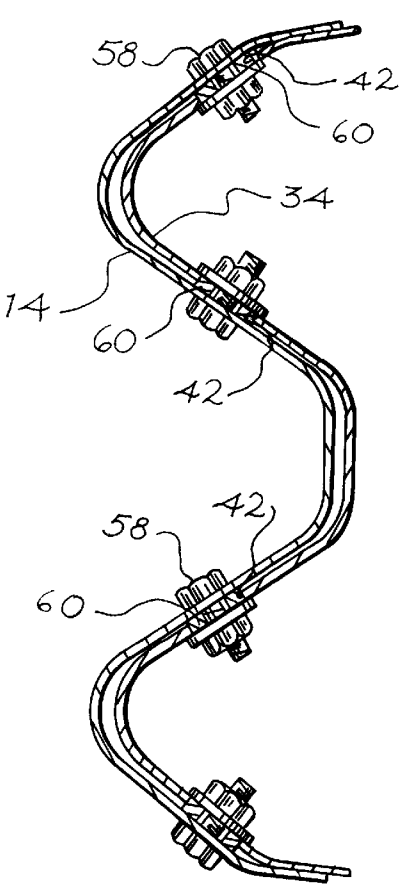
FIG. 8 is a cross-sectional view taken along 8—8 of FIG. 2.
Figure 7:
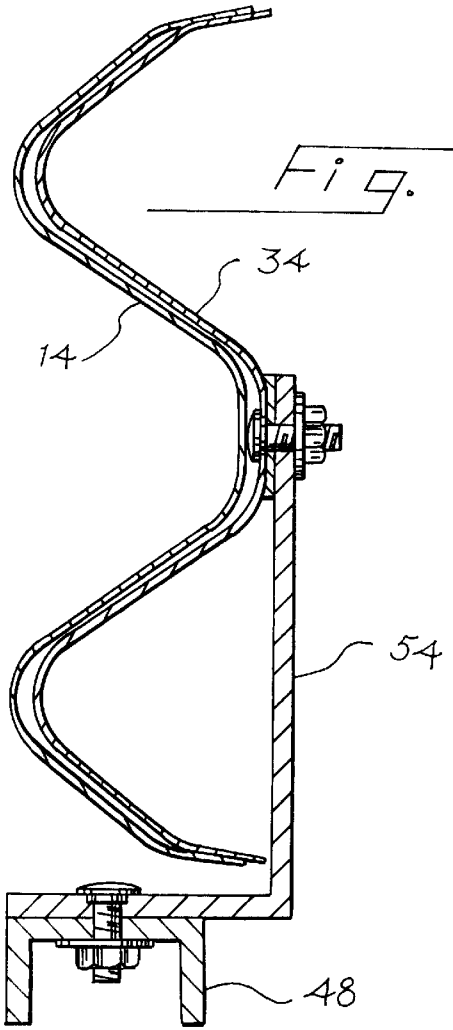
FIG. 7 is a cross-sectional view taken along line 7—7 of FIG. 2.

As best shown in FIG. 2, the impact-receiving element 30 is secured to the forward end 28 of the front rail 14 by threaded fasteners 58. FIG. 8 clarifies the structural relationships. Each of the fasteners 58 passes through a respective opening in the rail 14 and through a respective slot 42 in the guide rail 34. Spacers 60 ride within the slots 42 and are dimensioned to insure that the fasteners 58 do not clamp the guide rail 34 to the rail 14 so as to immobilize the guide rail 34. FIG. 7 is another cross-sectional view that shows the manner in which the angle bracket 54 is mounted to the guide rail 34 in such a way as not to interfere with sliding movement between the rails 14, 34.

Returning to FIG. 2, the forward end of the forward rail 14 is secured to the first post 18 by a threaded fastener 61 in the conventional manner. The window 56 ensures that the fastener 61 does not clamp the guide rail 34 to the first post 18 and thereby immobilize it.

A column 62 is mounted between the vehicle-engaging portion 32 and the first post 18. In this embodiment, the column 62 comprises a section of angle iron that is bolted to a strap that is in turn bolted in place between the post 18 and the vehicle-engaging portion 32.

Preferably the forward end of the first rail 14 is also secured to the first post 18 by a cable 64. This cable 64 is secured to the rail 14 at its rearward end by a conventional mounting bracket 66, and the cable 64 is secured at its forward end to the first post 18. Preferably, the mounting of the cable 64 to the rail 14 and the post 18 readily releases the cable 64 from the post 18 when the post 18 is broken in an axial impact, as described in U.S. patent application Ser. No. 08/990,468 filed Dec. 15,1997, assigned to the assignee of the present invention. The entirety of this related specification is hereby incorporated by reference.

Figure 9:
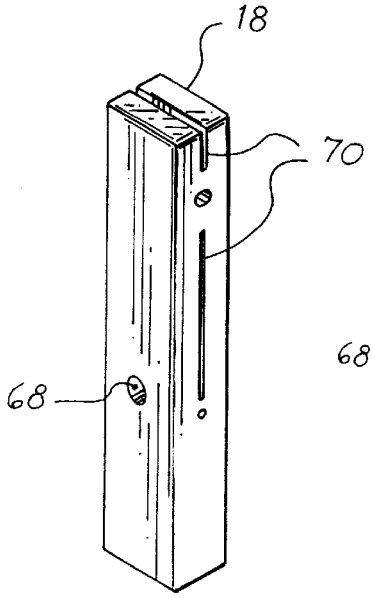
FIGS. 9, 10 and 11 are perspective views of three posts included in the embodiment of FIGS. 1–8.
Figure 10:
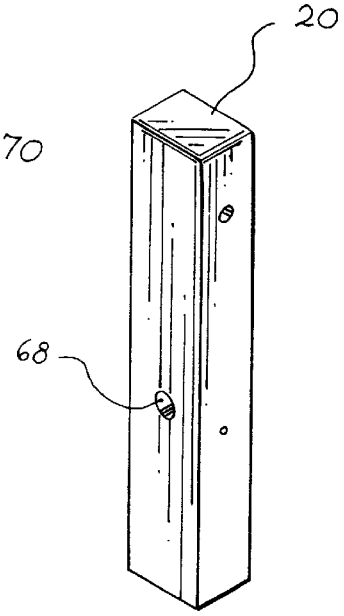
Figure 11:
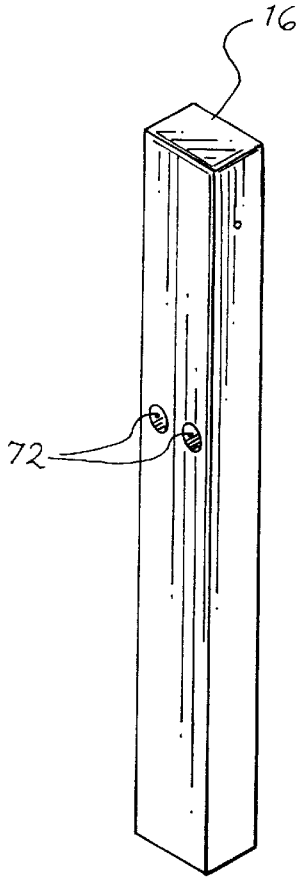

FIGS. 9 through 11 show perspective views of the posts 18, 20,16, respectively. The first and second posts 18, 20 are weakened with bores 68, and the first post 18 is additionally weakened by saw kerfs 70. The post 16 of FIG. 11 (which is used for posts 3–10 of the guardrail 10) is weakened by through bores 72.

Simply by way of example, the following additional structural details are provided to define the best mode of this invention. These details are intended only by way of illustration, and should clearly be understood to be preferred only. None of these details should be used to limit the scope of the following claims.

Figure 12:
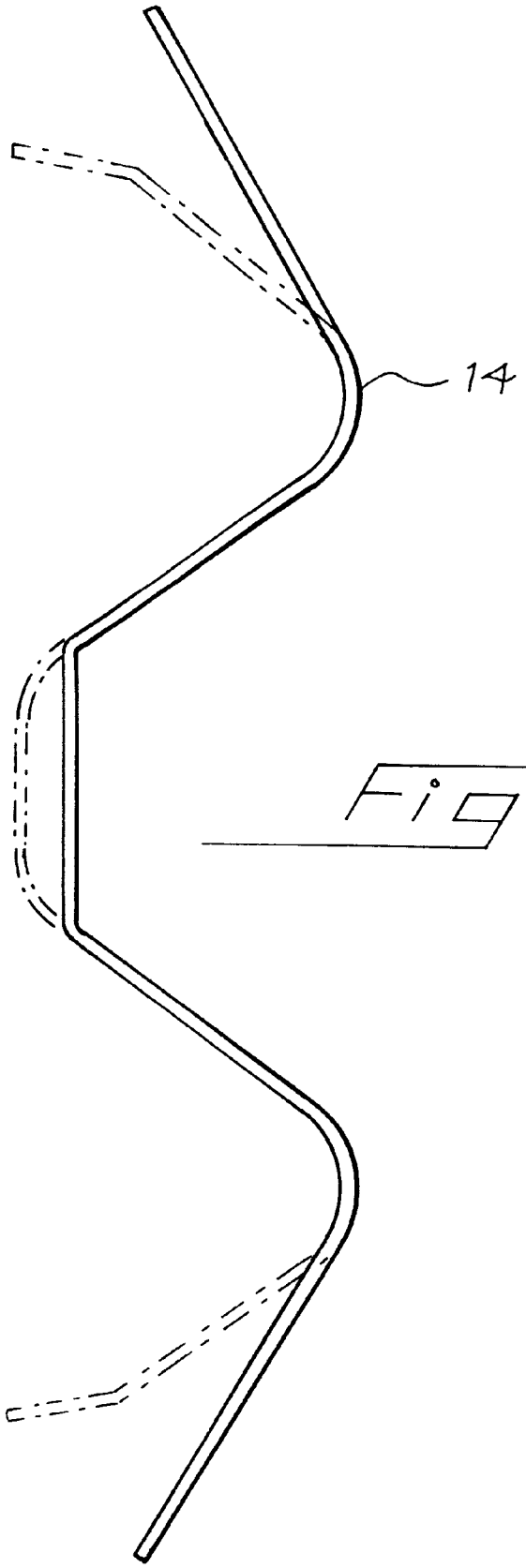
FIG. 12 is a cross-sectional view taken along line 12—12 of FIG. 1.

By way of example, the rails 34,14 may be formed of 12 gauge sheet metal shaped as defined in AASHTO specification M80-89 Class A, Type III. These rails may be hot-dip galvanized (Type II-zinc coated). A 2-inch upset positioned along a line perpendicular to the length of the rail completely across the rail may be formed in the first rail 14 approximately 15 centimeters in front of the center line of post 3. The vertical cross-section of the rail at the center of the upset can be shaped as shown in FIG. 12, in which the cross-section at the center of the upset or crimp is shown in solid lines and the uncrimped section is shown in dotted lines. The central valley is deformed by a maximum of 14 mm and the lateral edges are deformed by a maximum of 32 mm in this example. Similar upsets can be formed in the second and third rails 14 aligned with the center lines of posts 5 and 9, respectively. These upsets provide preferred bending positions for the array of rails 14 without reducing tensional strength excessively. In order to achieve the desired folding in an axial impact, the rails 14 are bolted to posts 1, 5 and 11, and to all remaining posts downstream of post 11. In this way, the posts provide backup to the array of rails 14 against an oblique impact, while the rails are left free to collapse away from selected ones of the posts in an axial impact.

The vehicle-engaging portion 32 can be fabricated of ¼-inch thick steel angles. The posts 18, 20 can be formed of wood (S4S min. grade 8 MPa) with a cross-sectional dimensions of 190×140 mm and a length of 1086 mm. The bores 68 can be 60 mm in diameter. The post 16 of FIG. 11 can be formed of wood, having cross-sectional dimensions of 203×152 mm and a length of 1830 mm. The bores 72 can be 63.5 mm in diameter. Preferably each post 16 is formed of select structural grade timber for 300 mm on either side of the bores 72. The remainder of each post can be #2 grade timber.

As assembled, the impact-receiving element 30 is slidably attached with low friction to the forward end of the forward guardrail 14, and the column 62 insures that compressive loads applied to the vehicle-engaging portion 32 are transmitted to an upper portion of the first post 18. In this embodiment, the slots 42 are 157 mm in length, and thus the limited stroke provided to the impact-receiving elements 30 is approximately 136 mm. In an axial impact, a vehicle traveling in the anticipated impact direction D first contacts a vehicle-engaging portion 32. As the vehicle pushes the vehicleengaging portion 32 rearwardly, the column 62 transfers compressive loads to the first post 18, thereby fracturing the first post 18 in the region of attachment of the cable 64. Once the first post 18 is broken, the cable attachment releases the cable 64 from the first post 18. This reduces the impact force required to buckle the rails 14, and thereby reduces decelerating forces applied to the impacting vehicle by the guardrail 10.

Continued rearward motion of the vehicle-engaging portion 32 and the guide rail 34 causes the tongue 44 to fit within the mating element 66 to immobilize the rearward end of the guide rail 34. This laterally reinforces the forward end of the first rail, because the guide rail 34 is at this point secured to the first rail 14 at both ends. This lateral reinforcement reduces the tendency of the rail 14 to buckle near the impacting vehicle and increases the tendency of the rail 14 to buckle away from post 3 at the first crimp. When the fasteners 58 reach the forward ends of the slots 42, further rearward motion of the impact-receiving element 30 causes rearward motion of the front end of the first rail 14. Note that the forward end of the brace 48 (FIG. 2) protrudes forwardly of the vehicle-engaging portion 32. This protrusion is designed to engage the impacting vehicle (not shown) in the region of the bumper or below, thereby resisting any tendency of the front end of the guardrail 10 to rise in an impact.

It should be apparent from the drawings that the frontal area A1 of the vehicle-engaging portion 32 (FIG. 2) is substantially larger than the frontal area A2 of the front face of one of the rails 14. In this example, the frontal area A1 is about 2100 $cm^2$ (457 mm×457 mm), and the frontal area A2 is about 13.3 $cm^2$ (494 mm×2.7 mm). The ratio A1:A2 is therefore approximately 157:1. The frontal area A1 is defined by the outer perimeter of the vehicle-engaging portion 32, regardless of whether or not there are internal openings in the vehicle-engaging portion 32.

Because the frontal area of the vehicle-engaging portion 32 is so large, there is a minimal tendency for the guardrail 10 to impale an impacting vehicle. Furthermore, since the impact-receiving element 30 is slidably mounted on the forward rail 14, initial deceleration spikes experienced by a lightweight impacting vehicle are reduced. Deceleration forces on the vehicle are applied in a direct manner to the forward post in order to minimize deceleration spikes at the beginning of the impact.

Of course, it should be understood that many changes and modifications can be made to the preferred embodiment described above. For example, the vehicle-engaging portion 32 can be shaped otherwise and formed of other materials. The ratio A1:A2 is preferably greater than 50:1, more preferably greater than 100:1, and most preferably greater than 150:1. If desired, a retroreflective material can be placed on or in the vehicle-engaging portion 32. The column 62 can be formed and shaped as desired, and in some embodiments may be formed of wood or other materials. The separate brace 48 is not required in all embodiments, and it is not required that the brace 48 protrude forwardly of the vehicle-engaging portion 32. If desired, the slots 42 can be formed in the first rail 14, or slots may be provided in both the rail 14 and the guide rail 34. Many other configurations are possible for the guide rail 34 and the rail 14, including corrugated rails having two or more valleys separated by parallel ridges.

As used herein, terms that appear in the following claims are intended broadly. For example, an array of elements is intended broadly to encompass one or more such elements.

The term "end" is intended broadly to encompass regions at and near the extreme end of an element.

The term "post" is intended broadly to encompass posts made of timber, metal or other materials.

The term "impact-receiving" indicates that the associated element receives at least some of the impacts on the guardrail. As explained above, oblique impacts to the intermediate portion of the guardrail may not contact the impact-receiving element.

Similarly, the term "anticipated impact direction" indicates one of several anticipated impact directions, in this case in a direction aligned with or at a small angle with respect to the longitudinal axis of the guardrail.

The term "slideably" is intended broadly to encompass relative translational movement of two overlapping elements, with or without restraints such as friction or deformation.

The term "roadway" is intended broadly to encompass any travel lane for vehicular traffic, including highways, tracks, trails and racecourses.

The term "skew" is intended broadly such that two elements are at skew angles at any time that they are neither parallel nor perpendicular to one another.

The foregoing detailed description has described only a few of the many forms that this invention can take. For this reason, this detailed description is intended as illustrative and not as limiting. It is only the following claims, including all equivalents, that are intended to define the scope of this invention.

What is claimed is:

1. In a guardrail comprising an array of vehicle-deflecting rails secured to an array of posts extending along a roadway, said array of rails comprising a first rail having a first end, said array of posts comprising a first post at the first end of the first rail, the improvement comprising:

an impact-receiving element slidably mounted to the first end of the first rail;

a stop coupled to at least one of the impact-receiving element and the first rail to limit sliding movement of the impact-receiving element relative to the first rail;

said impact-receiving element comprising a vehicle-engaging portion having a first frontal area A1, said first end of the first rail having a second frontal area A2, said first frontal area A1 being substantially greater than said second frontal area A2;

said impact-receiving element coupled with the first post such that impact forces on the vehicle-engaging portion are applied to the first post to break the first post before the stop limits sliding movement of the impact-receiving element relative to the first rail.

2. The invention of claim 1 wherein the impact-receiving element extends forwardly of the first post in an anticipated impact direction.

3. The invention of claim 2 further comprising a column interposed between the first post and the vehicle-engaging portion.

4. The invention of claim 2 wherein the impact-receiving element comprises a guide rail secured to the first rail.

5. The invention of claim 4 wherein at least one of the guide rail and the first rail comprises an array of slots, and wherein the guide rail is secured to the first rail by a plurality of fasteners that pass through the slots such that the slots and the fasteners form a guide that allows sliding motion between the first rail and the guide rail over a limited stroke.

6. The invention of claim 5 further comprising a brace secured between the guide rail and the vehicle-engaging portion.

7. The invention of claim 6 wherein the vehicle-engaging portion comprises a frame.

8. The invention of claim 5 further comprising a column secured between the first post and the vehicle-engaging portion.

9. The invention of claim 1 wherein the ratio A1:A2 is no less than about 100:1.

10. The invention of claim 1 wherein the ration A1:A2 is no less than about 150:1.

11. The invention of claim 1 wherein the vehicle-engaging portion is oriented at a skew angle with respect to the first rail.

12. The invention of claim 1 wherein the first post is disposed forwardly of all other posts of the guardrail in an anticipated impact direction.

13. The invention of claim 12 wherein the impact-receiving element is slideably mounted relative to the first post.

14. The invention of claim 1 wherein the ratio A1:A2 is no less than about 50:1.

15. The invention of claim 1 wherein the stop comprises a rearwardly protruding tongue positioned to engage a mating element on the first rail when the impact-receiving element is moved rearwardly in an impact.

16. The invention of claim 1 wherein the array of posts comprises a forwardmost post and an adjacent post in an anticipated impact direction, and wherein the stop is positioned between the forwardmost post and the adjacent post.

17. The invention of claim 1 wherein the first post is the forwardmost post in an anticipated impact direction, wherein the array of posts comprises a second post rearwardly adjacent to the first post, and wherein the stop is positioned forwardly of the second post in the anticipated impact direction.

18. The invention of claim 1 wherein the impact-receiving element is supported entirely by the first rail.

19. The invention of claim 1 further comprising a cable anchored at a forward end to the first post and at a rearward end to the first rail, wherein the first post is the forwardmost post of the array of posts in an anticipated impact direction.

20. The invention of claim 1 wherein the impact-receiving element is slideably mounted on the first rail relative to the first post.

21. In a guardrail comprising an array of vehicle-deflecting rails secured to an array of posts extending along a roadway, said array of rails comprising a first rail having a first end, said array of posts comprising a first post at the first end of the first rail, the improvement comprising:

an impact-receiving element slidably mounted to the first end of the first rail;

said impact-receiving element comprising a vehicle-engaging portion having a first frontal area A1, said first end of the first rail having a second frontal area A2, the ratio A1:A2 being no less than about 50:1;

wherein the impact-receiving element extends forwardly of the first post in an anticipated impact direction;

wherein the impact-receiving element comprises a guide rail secured to the first rail;

wherein at least one of the guide rail and the first rail comprises an array of slots; and wherein the guide rail is secured to the first rail by a plurality of fasteners that pass through the slots such that the slots and the fasteners form a guide that allows sliding motion between the first rail and the guide rail over a limited stroke;

further comprising a brace secured between the guide rail and the vehicle-engaging portion;

wherein the brace protrudes forwardly of the vehicle-engaging portion.

22. In a guardrail comprising an array of vehicle-deflecting rails secured to an array of posts extending along a roadway, said array of rails comprising a first rail having a first end, said array of posts comprising a first post at the first end of the first rail, the improvement comprising:

an impact-receiving element slidably mounted to the first end of the first rail;

said impact-receiving element comprising a vehicle-engaging portion having a first frontal area A1, said first end of the first rail having a second frontal area A2, the ratio A1:A2 being no less than about 50:1;

wherein the impact-receiving element extends forwardly of the first post in an anticipated impact direction;

wherein the impact-receiving element comprises a guide rail secured to the first rail;

wherein the guide rail comprises a rearwardly protruding tongue positioned to engage a mating element on the first rail when the guide rail is moved rearwardly in an impact.

23. In a guardrail comprising an array of vehicle-deflecting rails secured to an array of posts extending along a roadway, said array of rails comprising a first rail having a first end, said array of posts comprising a first post at the first end of the first rail, the improvement comprising:

an impact-receiving element slidably mounted to the first end of the first rail;

said impact-receiving element comprising a vehicle-engaging portion having a first frontal area A1, said first end of the first rail having a second frontal area A2, the ratio A1:A2 being no less than about 50:1;

wherein the impact-receiving element extends forwardly of the first post in an anticipated impact direction;

wherein the impact-receiving element comprises a guide rail secured to the first rail;

wherein at least one of the guide rail and the first rail comprises an array of slots;

wherein the guide rail is secured to the first rail by a plurality of fasteners that pass through the slots such that the slots and the fasteners form a guide that allows sliding motion between the first rail and the guide rail over a limited stroke;

further comprising a column secured between the first post and the vehicle-engaging portion;

wherein the column is dimensioned such that impact forces on the vehicle-engaging portion are applied to the first post to break the first post before the guide rail completes the stroke.

24. In a guardrail comprising an array of vehicle-deflecting rails secured to an array of posts extending along a roadway, said array of rails comprising a first rail having a first end, said array of posts comprising a first post at the first end of the first rail, the improvement comprising:

an impact-receiving element slidably mounted to the first end of the first rail;

said impact-receiving element comprising a vehicle-engaging portion having a first frontal area A1, said first end of the first rail having a second frontal area A2, said first frontal area A1 being substantially greater than said second frontal area A2;

said impact-receiving element coupled with the first post such that impact forces on the vehicle-engaging portion are applied to the first post;

said impact-receiving element slideably mounted on the first rail, and said impact-receiving element being free of attachment to the first post when in an initial condition, prior to application of said impact forces.

25. The invention of claim 24 wherein the impact-receiving element is supported substantially entirely by the first rail.

* * * * *

UNITED STATES PATENT AND TRADEMARK OFFICE

CERTIFICATE OF CORRECTION

PATENT NO. : 6,173,943 B1
DATED : January 16, 2001
INVENTOR(S) : James B. Welch et al.

It is certified that error appears in the above-identified patent and that said Letters Patent is hereby corrected as shown below:

Claim 10,
Line 1, delete "ration" and substitute -- ratio -- in its place.

Signed and Sealed this

Fifth Day of March, 2002

*Attest:*

*Attesting Officer*

JAMES E. ROGAN
*Director of the United States Patent and Trademark Office*